US009526358B2

(12) United States Patent
Pintur

(10) Patent No.: US 9,526,358 B2
(45) Date of Patent: Dec. 27, 2016

(54) APPARATUS FOR DISPLAYING SPECTACLES

(71) Applicant: Mladen Pintur, Zagreb (HR)

(72) Inventor: Mladen Pintur, Zagreb (HR)

( * ) Notice: Subject to any disclaimer, the term of this patent is extended or adjusted under 35 U.S.C. 154(b) by 69 days.

(21) Appl. No.: 14/418,875

(22) PCT Filed: Jul. 24, 2013

(86) PCT No.: PCT/EP2013/065659

§ 371 (c)(1),
(2) Date: Jan. 30, 2015

(87) PCT Pub. No.: WO2014/019918

PCT Pub. Date: Feb. 6, 2014

(65) Prior Publication Data

US 2015/0150390 A1 Jun. 4, 2015

(30) Foreign Application Priority Data

Jul. 30, 2012 (DE) ..... 10 2012 213 370

(51) Int. Cl.
*G08B 13/14* (2006.01)
*A47F 7/024* (2006.01)
*G08B 13/183* (2006.01)

(52) U.S. Cl.
CPC ..... *A47F 7/0243* (2013.01); *G08B 13/14* (2013.01); *G08B 13/183* (2013.01)

(58) Field of Classification Search
CPC ..... G06Q 10/087; H04W 12/06; H04W 12/08; G07F 9/026; A61B 2050/185; A61B 2050/105; B65G 1/127; B65G 1/137;B62H 5/20; A47F 7/024; A47F 7/0243; E05B 41/00
See application file for complete search history.

(56) References Cited

U.S. PATENT DOCUMENTS

2004/0019258 A1 1/2004 Kavounas et al.
2006/0071774 A1 4/2006 Brown et al.
(Continued)

FOREIGN PATENT DOCUMENTS

DE 202005004764 U1 11/2005
DE 102005003573 A1 7/2006
WO WO 2012/050435 A2 4/2012

OTHER PUBLICATIONS

International Searching Authority, International Search Report and Written Opinion for International Application No. PCT/EP2013/065659, Oct. 9, 2013, 16 pages, European Patent Office, The Netherlands.

(Continued)

*Primary Examiner* — Tesfaldet Bocure
(74) *Attorney, Agent, or Firm* — Alston & Bird LLP

(57) ABSTRACT

The invention relates to an apparatus for displaying spectacles, having a basic body (1) and having a plurality of accommodating devices (2), which are carried by the basic body (1) and are each intended for accommodating a pair of spectacles, wherein each accommodating device (2) comprises at least one bearing region (3) on which to rest the pair of spectacles. The apparatus is characterized by the provision of a contactlessly operating removal-prevention means (5) which in the handling region, immediately in front of the bearing region (3), defines a detection region which is influenced when the pair of spectacles is removed by hand and/or when the spectacle frame is moved past it.

11 Claims, 3 Drawing Sheets

(56) References Cited

U.S. PATENT DOCUMENTS

| | | | | |
|---|---|---|---|---|
| 2009/0014604 | A1 | 1/2009 | Pintur | |
| 2011/0288938 | A1* | 11/2011 | Cook | G06Q 30/0251 705/14.66 |
| 2012/0205326 | A1* | 8/2012 | Richter | A47F 7/024 211/4 |
| 2016/0147977 | A1* | 5/2016 | Adams | G06F 19/3462 700/232 |

OTHER PUBLICATIONS

The International Bureau of WIPO, International Preliminary Report on Patentability (English translation of the Written Opinion) for International Application No. PCT/EP2014/072646, Aug. 9, 2016, 6 pages, Switzerland.

* cited by examiner

APPARATUS FOR DISPLAYING SPECTACLES

CROSS REFERENCE TO RELATED APPLICATIONS

This application is a national stage application, filed under 35 U.S.C. §371, of International Application No. PCT/EP2013/065659 filed Jul. 24, 2013, which claims priority to German Application No. 10 2012 213 370.4, filed Jul. 30, 2012; the contents of both of which as are hereby incorporated by reference in their entirety.

BACKGROUND

Technical Field

The present invention relates to a device for displaying eyeglasses, said device comprising a base body and a plurality of accommodating devices, which are carried by the base body and each of which is intended for accommodating a pair of eyeglasses, wherein each accommodating device comprises at least one supporting region for placing the eyeglasses thereon.

Description of Related Art

Devices that form this genre have been known for some time from the field. One example of such a device is known from the DE 10 2005 003 573 A1, to which reference is made solely for illustrative purposes.

BRIEF SUMMARY

In the devices conforming to this genre, the base body is used to hold a plurality of accommodating devices and each of these accommodating devices in turn is designed to accommodate a pair of eyeglasses. In concrete terms the base body is designed as a column, and the accommodating devices are arranged vertically one above the other. Each of the accommodating devices comprises a supporting part for placing the respective pair of eyeglasses, always with the nose bridge, thereon. In order to secure against removal, a securing part is provided; and this securing part can be brought from a locking position, which secures the pair of eyeglasses, into a removal position, which releases the pair of eyeglasses. Usually the securing parts can be moved or more specifically can be pivoted jointly away from the locking position into the removal position and vice versa by means of a mechanical coupling.

On the back side of the base body, each accommodating device has a temple holder, which typically extends transversely to the base body. The temples of the eyeglasses can be placed on the temple holders, so that a pair of eyeglasses is carried by the accommodating device in a position, in which it can be seen in its entirety, and, in particular, is secured against theft (in the locking position) or in the opened state of the device (in the removal position) for trying on.

The devices that are known from the field are characterized by a complex mechanism. The parts that are used for securing are moved from one position to the other by means of mechanical coupling elements. In addition, the devices have the drawback that in the opened removal position, the eyeglasses are not secured, especially if the sales staff forgets to bring the device into the locking position.

Therefore, the object of the present invention is to provide by simple means an effective anti-theft protection system, which either replaces a mechanical lock or rather makes a mechanical lock unnecessary or, in addition to a mechanical lock, acts when the mechanical lock is temporarily released or deactivated.

The above engineering object is achieved by means of the features disclosed in patent claim 1, according to which the generic device is characterized by the provision of an operating without contact removal lock that in the handling region directly in front of the supporting region defines a detection range, which is influenced when the pair of eyeglasses is removed through access by the hand and/or when the eyeglass frame moves through said detection range.

It has been recognized, according to the invention, that a removal lock can operate in a contactless mode, i.e., without having to take the precaution of providing locking means that act by mechanical means. For this purpose it is necessary that the removal lock act in the handling region directly in front of the supporting region. For this purpose it is necessary that a detection range be defined in said handling region; and that said detection region is influenced when the pair of eyeglasses is removed through access by the hand and/or when the eyeglass frame moves through said detection range. In other words, the detection range is to be spanned in such a way that when the pair of eyeglasses is removed, either the hand of the person handling said pair of eyeglasses or at least the eyeglass frame at least touches the detection range, typically passes through the detection range. In this case the detection range is physically influenced, and the touching or more specifically the passage through the detection range can be detected by electrical or electronic means and can be indicated by either auditory and/or visual cues.

In an even more advantageous manner, the contactless removal lock works across a plurality, preferably across all of the supporting regions of a base body. Thus, the detection range extends across all of the supporting regions and at the same time secures these supporting regions. Correspondingly when the removal lock is switched on, all of the supporting regions can be monitored at the same time, as is the case with the known mechanical lock, with the advantage that the display of the eyeglasses is not adversely affected in any way by the mechanical locking means.

In concrete terms, it is conceivable and advantageous if the contactless removal lock has a first functional element in the region of the one end of the base body or more specifically in front of the first accommodating device and a second functional element in the region of the other end of the base body or more specifically after the last accommodating device. The two functional elements span the detection range. According to this embodiment, the detection range extends virtually over the entire length of the base body, at least over that section of the base body that is equipped with the accommodating devices.

At this point, it should be noted that the teaching of the invention can be furnished with any removal lock that operates in a contactless mode, irrespective of the principle, according to which the removal lock operates. In this respect it is essential that the detection range is defined by means of physical properties that do not require any mechanism. Irrespective of this advantage, however, it is conceivable that, in addition, a mechanical lock is provided in such a way that the two types of lock, i.e., the contact sensitive lock that operates by mechanical means and the lock that operates in a contactless mode, can complement or replace each other during operation, depending on the operating state of the entire device.

Especially if the inventive device is used to complement a mechanical anti-theft protection system, the device may be configured and equipped in such a way that the accommodating device comprises a supporting part for placing the pair of eyeglasses thereon and a securing part for mechanically securing the pair of eyeglasses placed thereon against removal. Preferably the securing parts can be pivoted jointly from a locking position, which secures the pair of eyeglasses, into a removal position, which releases the pair of eyeglasses. This removal lock is complemented in a particularly advantageous manner by means of an operating without contact removal lock that is automatically activated when at least one of the mechanical removal locks of a base body is brought into the removal position. In other words, the contactless removal lock is used for additional protection in the event that one or all of the mechanical removal locks are open. That is, they are in the release position so that when the eyeglass frame is removed, then at least a visual and/or auditory indication takes place.

As a general principle, it is also conceivable that for maximum security the contactless removal lock is activated or at least can be activated, irrespective of the locking/open state of the mechanical removal lock, in order to have additional protection against theft at all times.

In this specific case, the contactless removal lock operates in an inductive or capacitive mode, analogous to an anti-pinch protection system in the sliding doors of motor vehicles. Correspondingly the detection range is an electrical, magnetic and/or electromagnetic field that is influenced or rather disturbed by the hand removing the pair of eyeglasses or by the eyeglass frame. As a result, this arrangement allows the access and the removal of an eyeglass frame to be detected.

In a particularly advantageous manner, the contactless removal lock operates in a light optical manner, so that the detection range comprises at least one detection beam. In concrete terms, the light-optical removal lock can generate a detection beam in the infrared range, for which purpose an infrared emitter and an infrared receiver are required; and both said emitter and receiver define the detection beam directly in front of the accommodating device, preferably parallel to the base body.

Similarly, the light-optical removal lock can generate a laser light beam as the detection beam, for which purpose a laser light source and a laser light detector are required. In this case, too, the detection beam runs in an advantageous manner parallel to the base body directly in front of the accommodating device, so that the removal of an eyeglass frame can take place, only if the detection beam has been interrupted for at least a short period of time.

At this point, it should be noted that the base body can be arranged vertically, horizontally as well as diagonally or more specifically transversely. The detection beam runs preferably parallel to the base body, irrespective of the specific arrangement of the base body. This arrangement can be achieved in a very simple way in that the infrared light source or the laser light source is arranged at one end of the base body; and the corresponding detector or more specifically the receiver is arranged at the other end of the base body in a fixed orientation to each other. In this respect the actual positioning of the base body is irrelevant.

An indicator, which is assigned preferably to the base body, is provided in an additional advantageous manner. When the contactless removal lock is activated, said indicator indicates the activation, for example, in the form of a warning light or the like. Such a precautionary measure has the advantage that a third party will recognize the "arming" of the device, thus providing once again protection against removal. It is also conceivable that upon influencing the detection range a visual and/or auditory signal is and/or are triggered, for example, directly at the base body, in order to directly counteract, in particular, an unauthorized removal or in order to prevent a theft even at the instant of removal.

The teaching according to the invention can be implemented in an even more advantageous way by using an infrared light source or a laser light source and a corresponding detector, especially since a very short reaction time, in the range of a few milliseconds, is possible with a suitable configuration. In addition, the light path can be made visible, in particular, with the use of red light, as a result of which a kind of "optical" removal lock is created. It is also conceivable to make the respective light beam visible by coupling said light beam into a plexiglass element or by coupling said light beam out of a plexiglass element, for example, in the region of each accommodating device, which may be made at least partially of plexiglass.

As a general principle, it is possible to manufacture the entire accommodating device or at least parts thereof, for example, the supporting region, for the nose bridge of the eyeglass frame of plexiglass. In the context of such an embodiment the plexiglass could be used as a light guide, into which light from inside of the base body is coupled. The light from the respective plexiglass element can emerge at defined points, as a result of which a very special light-optical effect is achieved.

The base body can be made of aluminum, for example, in the form of a closed aluminum profile, so that current lines and/or light lines can be provided inside the base body, in order to supply, in particular, the functional elements or regions of the device with power and/or light.

When the individual accommodating devices are suitably spaced apart from each other, it has been demonstrated to be advantageous to arrange 18 accommodating devices for accommodating correspondingly 18 pairs of eyeglasses one above the other, so that the base body has a length of about 140 cm. If the base body is equipped exclusively with the contactless removal lock of the invention, no moving parts for securing against removal are required. Above all, however, the eyeglass frames that are placed on said base body are not visually degraded, so that an observer can look at the eyeglass frame unobstructed, and, in particular, from almost all sides. In this respect the precautionary measure of providing a base body, which can rotate in itself, constitutes an additional advantage.

It is also conceivable to assign a type of counter to the base body, for example, by means of an integrated processor. In this case the counter can be used to determine which of the accommodating devices, disposed on said basis body, is used at what frequency. In other words, it can be determined at the same time, how often a specific eyeglass frame is removed and is replaced or more specifically is placed on the supporting region. This feature makes it possible to determine the effect on the prospective buyers, so that it is possible to draw conclusions about the marketability of a particular eyeglass frame.

It has already been stated above that the contactless removal lock of the invention can also be combined with a mechanical removal lock. In this case the design of a combination device may be such that, when the mechanism is open, the light-optical removal lock is activated as an additional measure or rather as a complementary measure or more specifically is activated by the opening process. This arrangement provides a two stage protection against theft.

BRIEF DESCRIPTION OF THE FIGURES

There are a variety of possibilities of designing and further developing the teaching of the present invention in an advantageous manner. To this end, reference is made, on the one hand, to the patent claims that are dependent on patent claim 1 and, on the other hand, to the following explanatory description of a preferred exemplary embodiment of the invention with reference to the drawings. In conjunction with the explanatory description of the preferred exemplary embodiment of the invention with reference to the drawings, generally preferred embodiments and further developments of the teaching are also explained. The drawings show in FIG. 1 in schematic form a perspective view of an exemplary embodiment of a device according to the invention, wherein the base body is assigned a plurality of accommodating devices.

DETAILED DESCRIPTION OF VARIOUS EMBODIMENTS

Figure 1:
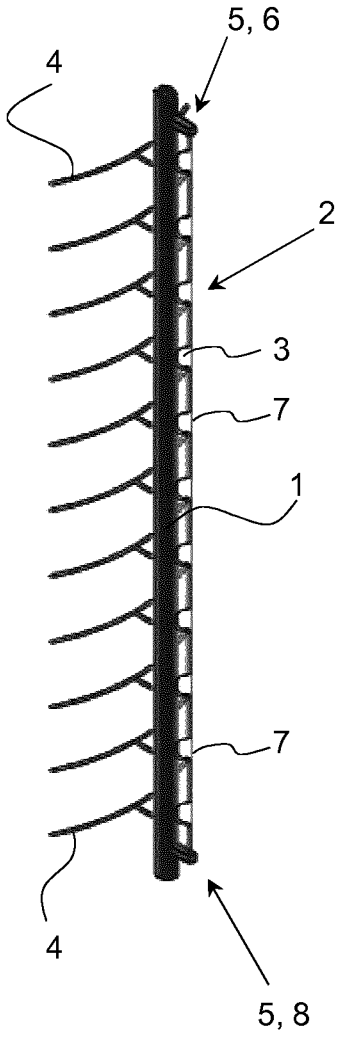
Figure 2:
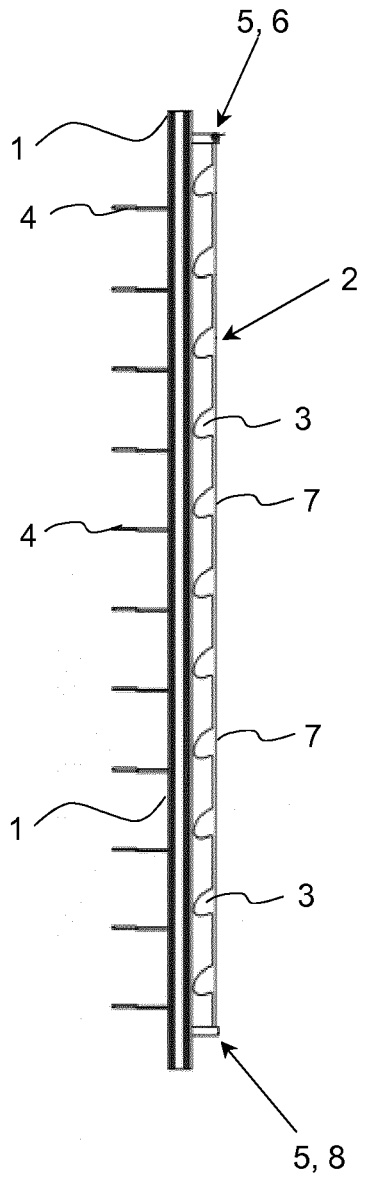
FIG. 2 in schematic form a side view of the subject matter from FIG. 1.
Figure 3:
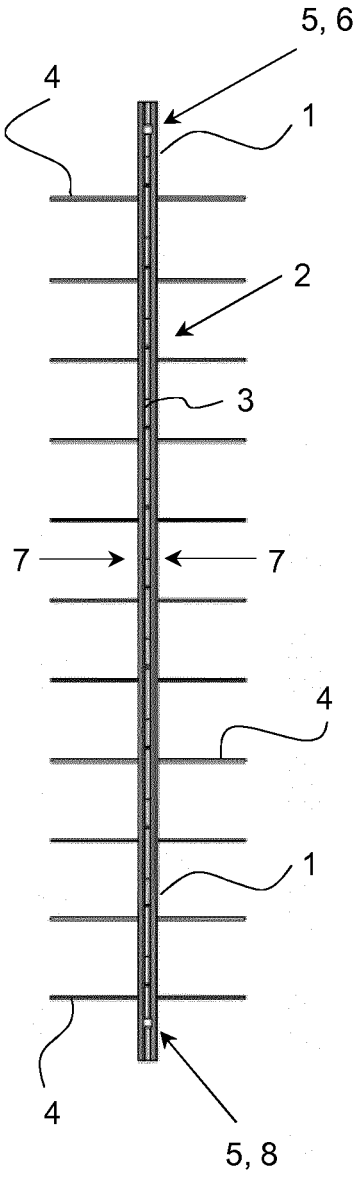
FIG. 3 in schematic form a front view of the subject matter from FIGS. 1 and 2.

FIGS. 1 to 3 show collectively an exemplary embodiment of an inventive device for displaying pairs of eyeglasses, where for the sake of simplicity the eyeglasses that are to be placed on said inventive device are not shown.

In this specific case, the device comprises a base body 1 for a vertical arrangement. The base body 1 carries a plurality of accommodating devices 2, each of which receives one pair of eyeglasses. Each accommodating device 2 in turn comprises a front supporting region 3 for placing the pair of eyeglasses or more specifically for placing the nose bridge of the eyeglasses thereon and a rear temple holder 4 for placing the two temples of an eyeglass frame thereon. As a result, a pair of eyeglasses can be placed in an optimal way on the supporting region 3 and the temple holder 4, in an almost horizontal position, ideal for viewing the pair of eyeglasses.

The device according to the invention is equipped with a removal lock 5 that operates in a contactless mode, in concrete terms, with a kind of light barrier, which operates with laser light.

For this purpose, the removal lock 5 comprises a laser light source 6, which emits a collimated laser light beam parallel to the base body 1, wherein the laser light source 6 can be arranged, for example, at the upper end of the base body, i.e. barely and just a little above the uppermost accommodating device 2. The laser light beam (detection beam 7) runs parallel to the base body 1 directly in front of the accommodating devices 2 or more specifically in front of the supporting region 3, so that then the detection beam 7 is always interrupted when a specific eyeglass frame is removed from one of the accommodating devices 2 or is placed again on the accommodating device 2.

A detector 8 for detecting the laser light beam 7 is disposed at the lower end of the base body 1, i.e. directly below the bottommost accommodating device or more specifically below the bottommost supporting region 3, where in this case the laser light source 6 and the detector 8 operate in the sense of a light barrier.

Once again, it should be emphasized that the removal lock that operates in a contactless mode can be designed in a number of very different ways; and, hence, it can comprise a detection system that operates on a capacitive and/or eddy current basis. In this case the essential feature of the present invention is merely that the device operates in a contactless mode, when viewed alone or in addition to a mechanical removal lock, which is known, for example, from the DE 10 2005 003 573 A1.

With respect to other advantageous embodiments, which cannot be derived from the figures, reference is made to the general part of the description, in order to avoid repetition. In addition, it should also be noted that the above described exemplary embodiment from FIGS. 1 to 3 is used merely as an example to explain the teaching that is claimed, but it does not restrict the teaching to the said exemplary embodiment.

LIST OF REFERENCE NUMERALS

1 base body
2 accommodating device
3 supporting region
4 temple holder
5 contactless removal lock
6 laser light source
7 detection beam (laser light beam)
8 detector (for the laser light)

The invention claimed is:

1. Device for displaying eyeglasses, said device comprising:

a base body (1);

a plurality of accommodating devices (2), said plurality of accommodating devices (2) being carried by the base body (1) and being configured for accommodating a respective pair of eyeglasses; and an operating without contact removal lock (5) that in the handling region directly in front of the supporting region (3) defines a detection range, which is influenced when the pair of eyeglasses is removed from the device or when the eyeglass frame moves through the handling region, wherein:

each accommodating device (2) comprises at least one supporting region (3) for placing the eyeglasses thereon;

the contactless removal lock (5) works across a plurality of the supporting regions (3) of the base body (1), so that the detection range extends across all of the supporting regions (3);

the contactless removal lock (5) has a first functional element in the region of the one end of the base body (1) or more specifically in front of the first accommodating device (2) and a second functional element of the contactless removal lock (5) in the region of the other end of the base body (1) or more specifically after the last accommodating device (2); and the first and the second functional element span the detection range.

2. Device, as claimed in claim 1, wherein the contactless removal lock (5) works across all of the supporting regions (3) of the base body (1).

3. Device, as claimed in claim 1, wherein the contactless removal lock (5) operates in an inductive or capacitive mode, so that the detection range comprises at least one of an electrical, magnetic or electromagnetic field.

4. Device, as claimed in claim 1, further comprising an indicator, which is assigned to the base body (1) and which in the event of an activated contactless removal lock (5) indicates the activation, for example, in the form of a warning light or the like.

5. Device, as claimed in claim 1, wherein upon influencing the detection range at least one of a visual or an auditory signal is triggered.

6. Device for displaying eyeglasses, said device comprising:

a base body (1);

a plurality of accommodating devices (2), said plurality of accommodating devices (2) being carried by the base body (1) and being configured for accommodating a respective pair of eyeglasses; and an operating without contact removal lock (5) that in the handling region directly in front of the supporting region (3) defines a detection range, which is influenced when the pair of eyeglasses is removed from the device or when the eyeglass frame moves through the handling region, wherein:

each accommodating device (2) comprises a supporting part for placing the pair of eyeglasses thereon and a securing part for mechanically securing (5) the pair of eyeglasses placed thereon against removal;

the securing parts can be pivoted preferably jointly from a locking position, which secures the pair of eyeglasses, into a removal position, which releases the pair of eyeglasses; and then the contactless removal lock (5) is automatically activated when at least one mechanical removal lock is located in the removal position.

7. Device for displaying eyeglasses, said device comprising:

a base body (1);

a plurality of accommodating devices (2), said plurality of accommodating devices (2) being carried by the base body (1) and being configured for accommodating a respective pair of eyeglasses; and an operating without contact removal lock (5) that in the handling region directly in front of the supporting region (3) defines a detection range, which is influenced when the pair of eyeglasses is removed from the device or when the eyeglass frame moves through the handling region, wherein:

each accommodating device (2) comprises at least one supporting region (3) for placing the eyeglasses thereon;

the contactless removal lock (5) operates in a light optical manner, so that the detection range comprises at least one detection beam (7).

8. Device, as claimed in claim 7, wherein the light optical removal lock generates a detection beam (7) in the infrared range, i.e., comprises an infrared emitter and an infrared receiver.

9. Device, as claimed in claim 7, wherein the light optical removal lock generates a detection beam (7) via an infrared emitter and an infrared receiver.

10. Device, as claimed in claim 7, wherein the light optical removal lock generates a laser light beam as the detection beam (7), i.e., comprises a laser light source (6) and a laser light detector.

11. Device, as claimed in claim 7, wherein the light optical removal lock generates a laser light beam via a laser light source (6) and a laser light detector.

* * * * *